United States Patent [19]

Hirota et al.

[11] Patent Number: 5,072,526

[45] Date of Patent: Dec. 17, 1991

[54] CLOTHES DRYER

[75] Inventors: Tatsuya Hirota, Kyoto; Kiyokazu Fujikawa, Shiga; Yoshiaki Aoki, Otsu; Tamotsu Kawamura, Yokaichi; Yozo Kawamura, Otsu; Kouichi Tanaka, Otsu; Takafumi Hamano, Otsu, all of Japan

[73] Assignee: Sanyo Electric Co., Ltd., Osaka, Japan

[21] Appl. No.: 452,593

[22] Filed: Dec. 18, 1989

[30] Foreign Application Priority Data

| | | | |
|---|---|---|---|
| May 26, 1989 | [JP] | Japan | 1-134054 |
| May 31, 1989 | [JP] | Japan | 1-138615 |
| Jun. 19, 1989 | [JP] | Japan | 1-156242 |

[51] Int. Cl.[5] ..... F26B 19/00

[52] U.S. Cl. ..... 34/60; 34/133

[58] Field of Search ..... 34/133, 60, 12, 9

[56] References Cited

U.S. PATENT DOCUMENTS

| | | | |
|---|---|---|---|
| 2,846,776 | 8/1958 | Clark | 34/60 |
| 3,103,450 | 9/1963 | Janson | 34/60 |
| 3,215,311 | 11/1965 | Nison et al. | 34/60 |
| 3,267,701 | 8/1966 | Mandarino | 34/60 |
| 3,633,538 | 1/1972 | Hoeflin | 34/60 |
| 3,706,140 | 12/1972 | Brillaud et al. | 34/60 |
| 3,736,668 | 6/1973 | Dillarstone | 34/60 |
| 4,053,992 | 10/1977 | Furgal | 34/60 |
| 4,236,320 | 12/1980 | Schwadike et al. | 34/60 |
| 4,254,139 | 3/1981 | Hendrickson et al. | 34/60 |
| 4,532,719 | 8/1985 | Davies et al. | 34/60 |
| 4,532,722 | 8/1985 | Sax | 34/60 |
| 4,567,675 | 2/1986 | Rennie | 34/60 |
| 4,642,908 | 2/1987 | Brenner | 34/60 |
| 4,891,890 | 1/1990 | Church | 34/60 |

FOREIGN PATENT DOCUMENTS

| | | |
|---|---|---|
| 58-124493 | 7/1983 | Japan . |
| 58-133300 | 8/1983 | Japan . |

*Primary Examiner*—Henry A. Bennet
*Assistant Examiner*—Denise L. F. Gromada
*Attorney, Agent, or Firm*—Darby & Darby

[57] ABSTRACT

A clothes dryer comprising a body having a drying chamber defined for accommodating clothes; a heater provided in the body; a heated air path for supplying dried air heated by the heater to the drying chamber to dry the clothes placed in the drying chamber; a door for closing and opening the drying chamber; a porous member impregnated with an agent; a supporting member provided on the door, detachably holding the porous member and provided with an aperture for supplying the agent held by the porous member into the drying chamber.

8 Claims, 7 Drawing Sheets

CLOTHES DRYER

BACKGROUND OF THE INVENTION (i) Field of the Invention

The present invention relates to a clothes dryer and, more specifically, to a clothes dryer for supplying heated air to a drying chamber to dry clothes placed in the drying chamber.

(ii) Description of the Prior Art

It is proposed in using a clothes dryer to supply to clothes in a drying chamber, specific agents, such as static electricity erasing agent for preventing dried clothes from generating static electricity, a rinse for softening clothes, an aromatic for applying a nice smell to the clothes, etc. for a good result of the dried clothes.

To supply an agent to the drying chamber, Japanese Unexamined Patent Application 124493/1983 proposes use of an ultrasonic oscillator, and Japanese Unexamined Patent Application 133300/1983 proposes use of a pump. However, there is the possibility that the agent remaining in the pump can solidify and, therefore, any agent can no longer be supplied through the pump; and there is also the disadvantage that when the constitution of the machine becomes complex, the manufacturing costs become prohibitive.

SUMMARY OF THE INVENTION

A clothes dryer according to the present invention comprises a body having a drying chamber defined for accommodating clothes; drying means for supplying heated air to the drying chamber to dry the clothes placed in the drying chamber; a door for closing and opening the drying chamber; a container holding an agent; a supporting member for supporting the container provided on the door, which can be detached, holding the container and provided with an aperture for supplying the agent held by the container into the drying chamber.

According to the present invention, by mounting the container holding a supply of the agent inside the drying chamber, the agent can be applied to the clothes simply which eliminates the need for supplying the agent from the outside of the machine.

According to the present invention, the container mounting member which possesses an aperture for dispersal of the agent is mounted on the door and can be detached and refilled when required.

A porous containment vessel made of metal or composite resin is preferably used as the container and, more preferably, a porous containment vessel of sintered metal is used. The container holds or supports the agent, such as a static electricity erasing agent (for example, dialkyldimethyl-ammonium-chloride as the softening agent and dialkyldimethyl-ammonium-chloride, as an aromatic floral extract used as a perfume, or the like).

BRIEF DESCRIPTION OF THE DRAWINGS

FIG. 1 is a sectional view of the embodiment;

FIGS. 2(*a*), 2(*b*) and 2(*c*) are views of a mounting base, a supporting member and a pushing plate, respectively;

FIGS. 3 to 5 show the operation for attaching the supporting member and a porous member:

FIGS. 3(*a*), 4 and 5(*a*) are sectional view showing the major parts;

FIGS. 3(*b*) and 5(*b*) are views seen in a direction shown by the arrow B of FIG. 1;

FIG. 5(*c*) is a sectional view taken along line C—C' of FIG. 5(*b*);

FIG. 6 is a circuit block diagram;

FIG. 7 is a sectional view;

FIGS. 8 and 9 are sectional views showing the major parts; and

DETAILED DESCRIPTION OF THE PREFERRED EMBODIMENTS

FIGS. 1 to 6 show an embodiment according to the present invention. A clothes dryer of the embodiment is a so-called dehumidifying type clothes dryer having a double-sided fan of the kind used for heat exchange. This fan circulates heated air through a heated air path comprising a drum (drying chamber), through a double-sided fan, duct and a heater.

Figure 1:
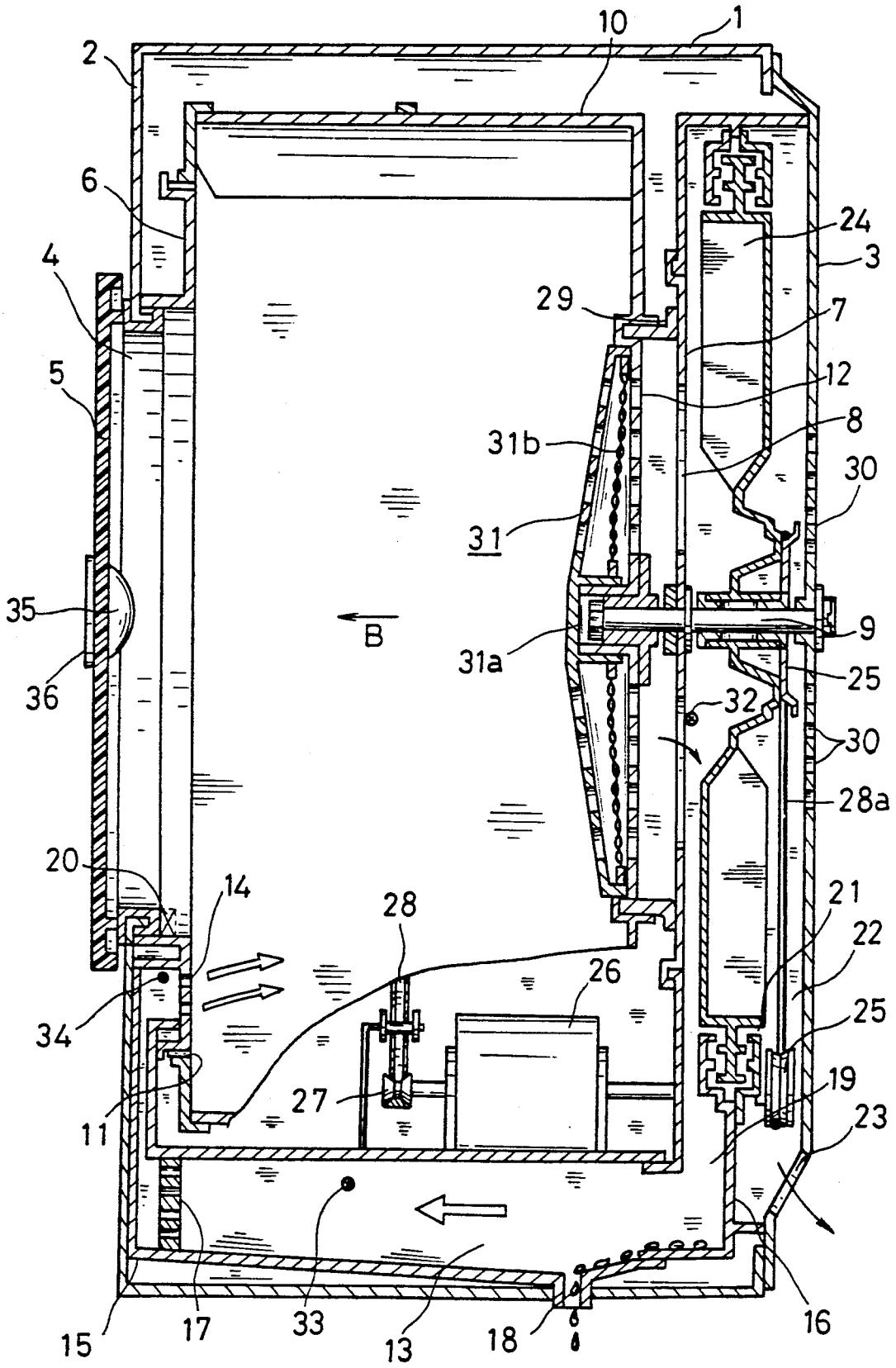
FIGS. 1 to 6 show an embodiment according to the present invention.
Figure 2A:
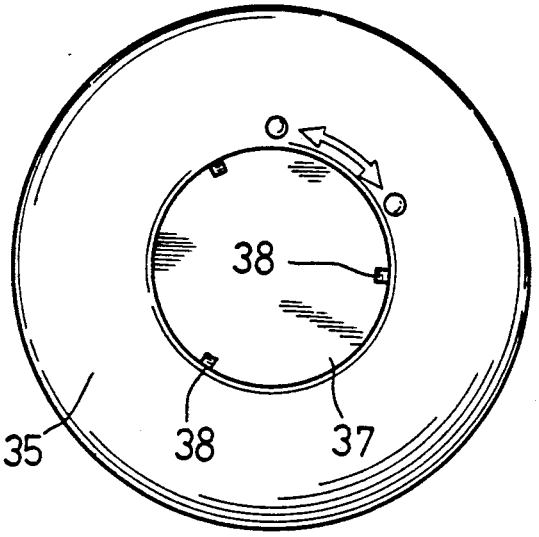
Figure 2B:
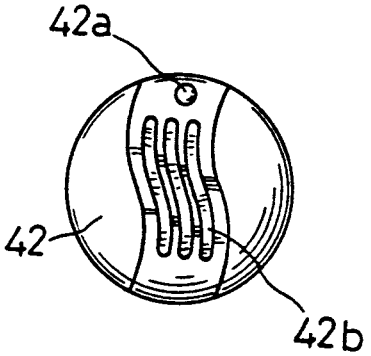
Figure 2C:
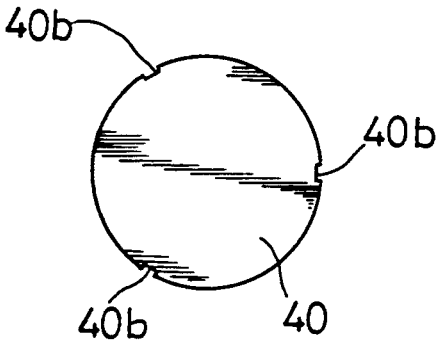
Figure 3A:
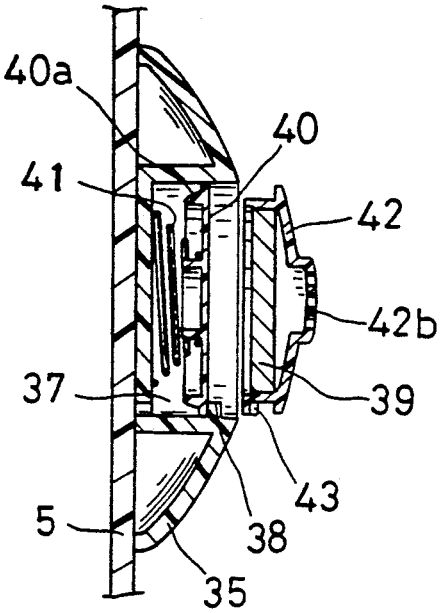
Figure 3B:
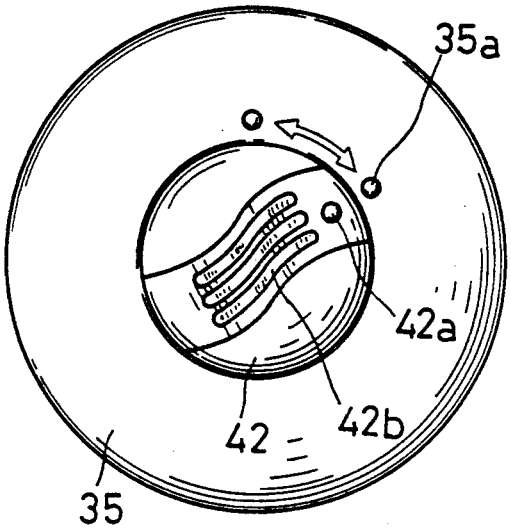

Referring to FIG. 1, the clothes dryer comprises a metal housing 1 of the clothes dryer, front and rear panels 2, 3 secured to the edges of the front and rear openings of the housing 1, an opening 4 for insertion and removal of clothes formed by the front panel 2 with a door 5 made of transparent resin and is attached to the front panel 2. The clothes dryer further is comprised of an annular metal drum support plate 6 positioned in the front part of the housing 1 and secured to both the housing 1 and the front panel 2; a metal partition member 7 fixed to opposite sides of the housing 1 in the rear portion thereof, and many air holes 8 extending in a radial pattern from the center of the partition member 7.

Further referring to FIG. 1, an elongated shaft 9 extends in the transverse direction in the middle part of the partition member 7 and is fixed to the rear panel 3. A molded drum 10 made of resin is supported during rotation by the drum support plate 6 through a felt pad 11 in its outer peripheral portion. The drum 10 has a bearing fixed at the middle portion in its rear wall and is attached to the front end of the shaft 9 at that part and fixed with a bolt and a nut, so that the drum 10 is held to the housing 1, the door 5 and a filter device explained below. The drum 10, in its rear wall, is provided with a heated air outlet 12 possessing many bores or radial slits and acts as a drying chamber having its front opening opposite that of the opening 4 for insertion and removal of clothes.

The drum support plate 6 is provided with a heated air inlet 14 in its lower right portion and a heated air path 13 which is one of components of drying means connects with the heated air inlet 14 through the air holes 8 in the partition member 7. The heated air path 13 is composed of an L-shaped duct 15 formed in the drum support plate 6 and a cylindrical circulation casing 16 which covers (air tight) the rear face of the partition member 7. A heater 17, which is another component of the drying means, is made of a honeycomb construction and has the property of having positive resistance to temperature. A drain pipe 18 is formed in the bottom of the duct 15 projecting from the dryer body. A heated air path 19 is defined by the circulation casing 16 and connects with the duct 15. A door switch 20 sensor determines whether the door 5 is opened or closed.

A cooling casing 21, which is of almost the same shape as the circulation casing 16, is formed contiguous with the rear wall of the circulation casing 16 and acts as an air path for cool air in a downward direction. The cooled air path 22 is separated from the heated air path 19 and connects with a cooled air outlet formed in the bottom of the housing 1. A heat exchange type double sided fan 24 is positioned between the circulation casing 16 and the cooling casing 21 and is supported by the shaft 9 in its rear portion. Pulleys 25 are connected to the double sided fan 24 to allow for rotation. A motor 26 is positioned in the inner bottom portion of the housing 1. The motor 26 rotates the drum 10 at a low speed through pulleys 27 including an idler pulley and a belt 28 while it rotates the double sided fan 24 at high speed by means of the pulleys 25 and belt 28*a*. The motor 26 is a condenser motor. The drum 10 rotates in the counterclockwise direction, if seen from the rear panel 3 shown by the arrow B in FIG. 1.

A seal member 29 seals a passage between the heated air outlet 12 and the air holes 8. A cooled air inlet 30 is placed in the middle of the rear panel 3. A filter device 31 covers the heated air outlet 12 in the rear wall of the drum 10 and is detachable in the inside of the drum 10 to remove waste fibers which come off from clothes. The filter device 31 consists of a filter cover 31*a* having many holes and a lint filter 31*b*. The drying means is made up of the duct 15 which is a part of the heated air path 13, the double sided fan 24, the motor 26, the heater 17, etc.

The first thermistor 32 is positioned on the back of the partition member 7 to measure the temperature of discharged air at the heated air outlet 12, the second thermistor 33 is positioned within the duct 15 to measure the temperature of the discharged air after heat exchange and dehumidification and before re-heating, and the third thermistor 34 is positioned close to the heated air inlet 14 within the duct 15 to measure the temperature of the discharged air after re-heating. A mounting base 35 on which a container is mounted is attached by ultrasonic welding to the inner surface of the door 5 which acts as the drying chamber together with the drum 10 but does not rotate with the drum. An ornament plate 36 keeps the mounting part of the mounting base 35 from being seen. Referring to FIGS. 2 to 5, a cylindrical concave mounting portion 37 formed in the mounting base 35, possesses projections 38 for mechanical engagement formed on the inner peripheral surface of the concave mounting portion 37, and a porous member (or a substrate) 39 serves as the container. The concave mounting portion 37 is a cylinder which is positioned coaxially with the rotation axis of the drum 10, namely, in the middle portion of the door 5. The porous member 39 is made of sintered metal (for example, made by sintering stainless powder) and contains a liquid agent such as an aromatic for clothes. The porous member 39 is held by the concave mounting portion 37 in the drying chamber as described below with a liquid agent. A pushing plate 40 is energized by means of a spring 41 pushing toward the opening of the concave mounting portion 37. A supporting member 42 has a hook-shaped projection 43 on its cylindrical peripheral surface. The hook-shaped projection 43 engages with the projection 38 so that the porous member 39 is held tight to the concave mounting portion 37.

The outer diameter of the pushing plate 40 is almost the same as the inner diameter of the concave mounting portion 37, and its rear surface has a slope 40*a*. Also, the pushing plate 40 is provided with a notch 40*b* on its peripheral surface corresponding to the projection 38. The notch 40*b* is an opening to which the projection 38 partly fits.

In assembling, the spring 41 is positioned within the concave mounting portion 37, and the pushing plate 40 is thrust into the concave mounting portion 37 while the projection 38 is positioned to the notch 40*b*. At this time, the slope 40*a* guides the projection 38, and the pushing plate 40 bends to slip in the concave mounting portion 37. The projection 38 prevent the pushing plate 40 from slipping out of the concave mounting portion 37 (see FIG. 3(*b*)).

Figure 4:
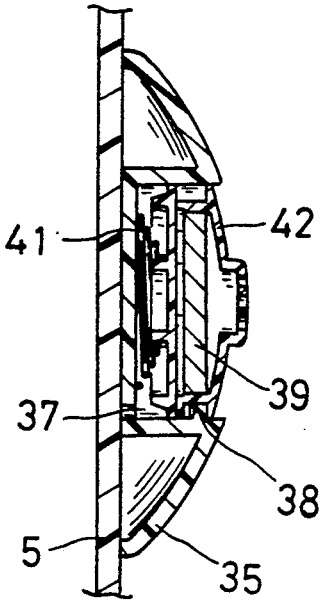
Figure 5A:
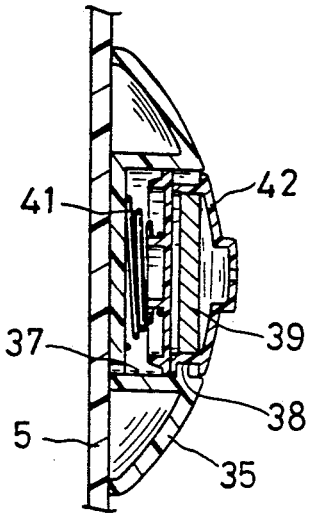
Figure 5B:
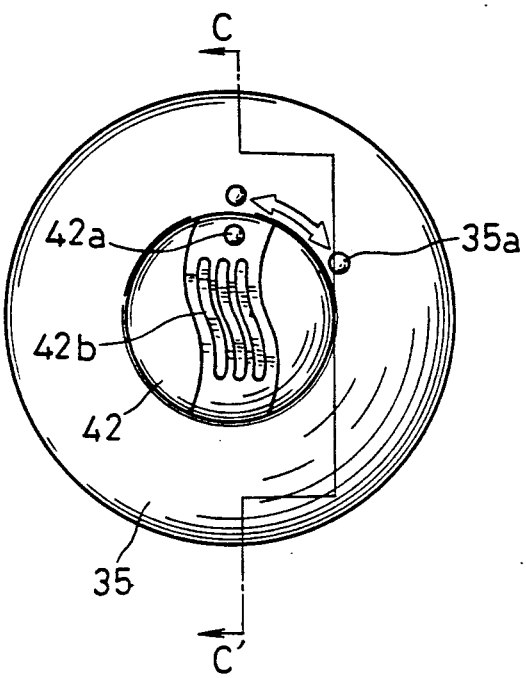
Figure 5C:
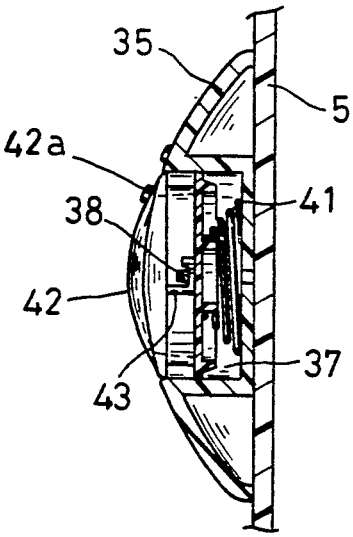

Then, the porous member 39 containing the liquid agent is slipped in the supporting member 42, an indicator 42*a* of the supporting member 42 is put at an "OUT" indicator 35*a* on the mounting base 35 (see FIG. 3), and the supporting member 42 is thrust against the pushing force of the spring 41 (see FIG. 4). When it is rotated counterclockwise by about 60, the projections 38 and 43 engage by the force of the spring, so that the supporting member 42 is mounted on the mounting base 35. Thus the porous member 39 is held (see FIG. 5) firmly.

Figure 6:
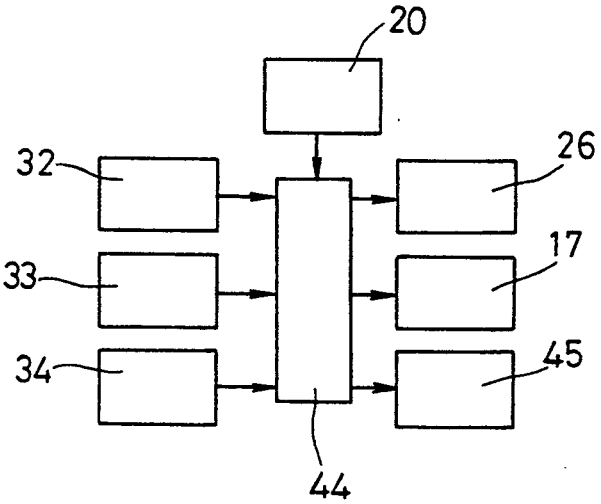

FIG. 6 is a circuit block diagram showing a microcomputer which refers the information from the thermistors 32, 33, 34 to control the motor 26 and the heater 17, and a keyboard for inputting information.

When instructions are given from the keyboard 45 to start drying, the microcomputer 44 supplies electric power to the motor 26 and the heater 17 to start the drying process. The double sided fan 24 rotates by the motor 26 to circulate air, the air is heated by the heater 17, and the heated air is supplied to the drum 10 to dry clothes therein. The heated air which contains moisture from the clothes, is sent out from the heated air outlet 12 to return to the double sided fan 24. The air containing moisture is subjected to heat exchange by the double sided fan 24 with cooled air taken from the cooled air inlet 30. Moisture from the clothes are condensed into water droplets. The water droplets fly about because of the rotation of the double sided fan 24, pass through the heated air path 19 and pass out of the drying machine through the drain pipe 18.

The porous member 39 is also heated by the heated air during the drying process. This causes the aromatic held in by the porous member 39 to appear on its surface. The aromatic on the surface of the porous member 39 is vaporized. The vaporized aromatic flows to the drying chamber through the slit 42*b*, fills the drying chamber and attaches to the clothes in the drying chamber to emit fragrance. This process is most effectively accomplished in the dehumidifying type clothes dryer of this embodiment, because heated air is circulated inside the machine without being exhausted out of the machine. If you increase or decrease the amount of the aromatic to be attached to the clothes, the slit 42*b* may be provided with an adjuster (not shown) of shape memory alloy to alter the area of the opening of the slit 42*b* according to temperature.

The microcomputer 44 carries out the drying process by determining the end of drying cycle from information received from the thermistors 32, 33. A process of judging the end of drying is disclosed in Japanese Examined Patent Application 26397/1986, Japanese Unexamined Patent Application 163400/1983 and so forth, and hence the description is omitted herein. When drying is completed, the microcomputer 44 stops supplying electric power to the motor 26 and the heater 17.

Thus, according to the present invention, using a simple constitution, the container can be positioned within the drying chamber and a liquid agent such as an aromatic can be supplied, at a moderate cost without possibility of malfunction.

Further, according to the present invention, the projection 38 and the part 43 engage when the supporting member 42 rotates in the same direction as the drum 10. Even if clothes to be dried brush against the supporting member 42, because of the rotation of the drum 10, force caused by the brushing is applied to enforce the engagement between the projection 38 and the 43, and there is no possibility that the supporting member 42 and the porous member 39 can be displaced.

Though the concave mounting portion 37 is placed inside the door 5 in this invention, it may be placed on the surface of the filter device 31 which is another non-rotating element within the drying chamber. When the porous member 39 is attached to the door 5 as in this invention, there is an advantage that the porous member 39 can be easily detached and a liquid agent such as an aromatic can be easily supplied.

Although the porous member 39 holds a liquid agent such as an aromatic, a solid agent may be used as the container instead of the porous member 39. Moreover, the slit 42*b* may be widened and the porous member 39 loaded with a static electricity erasing agent so that clothes directly touch the porous member 39 because of the rotation of the drum 10 during a drying process, and therefore the static electricity erasing agent in the surface of the porous member 39 attaches to the clothes.

Figure 7:
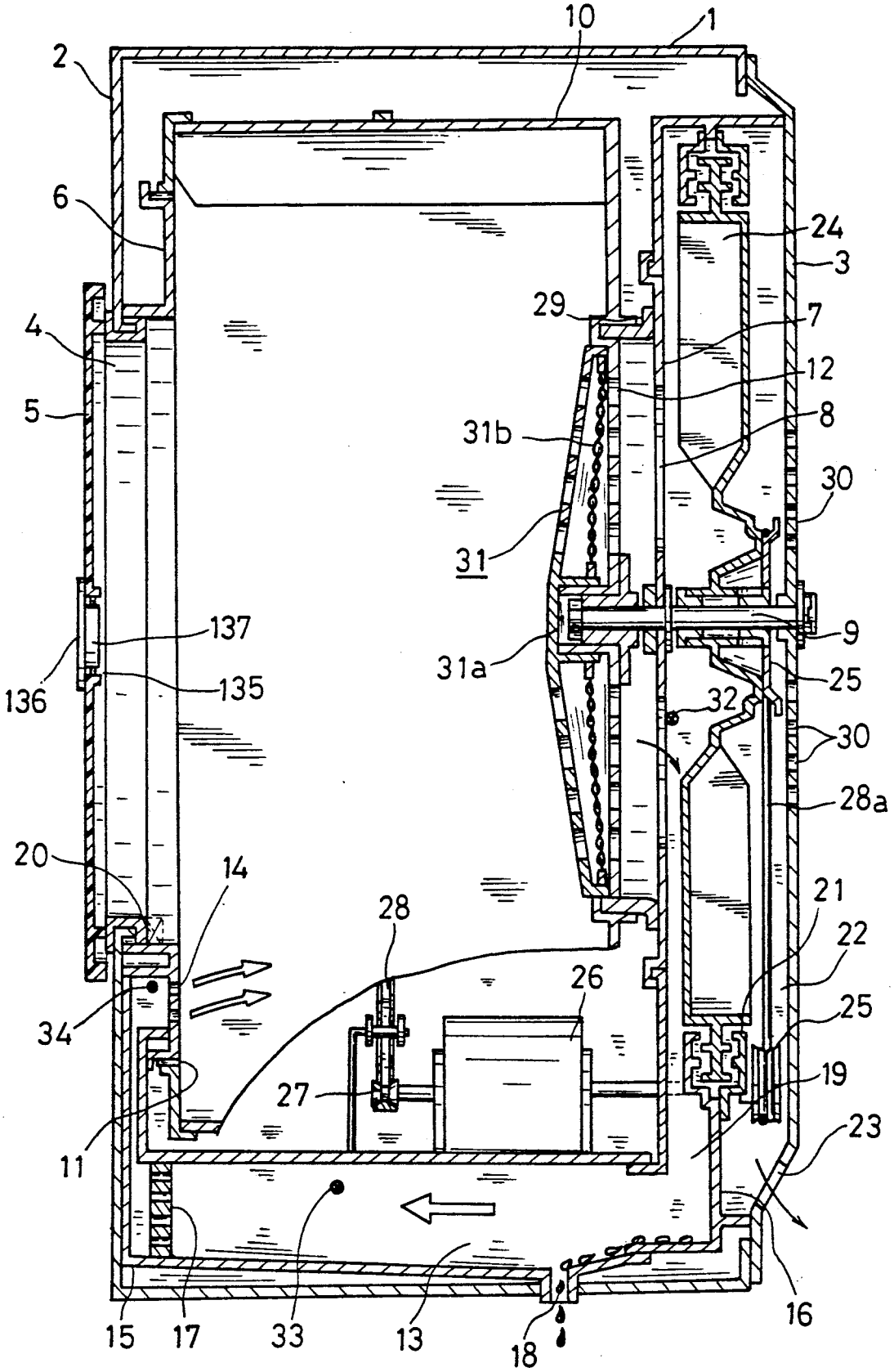
FIG. 7 to 9 shows another embodiment according to the present invention.
Figure 9:
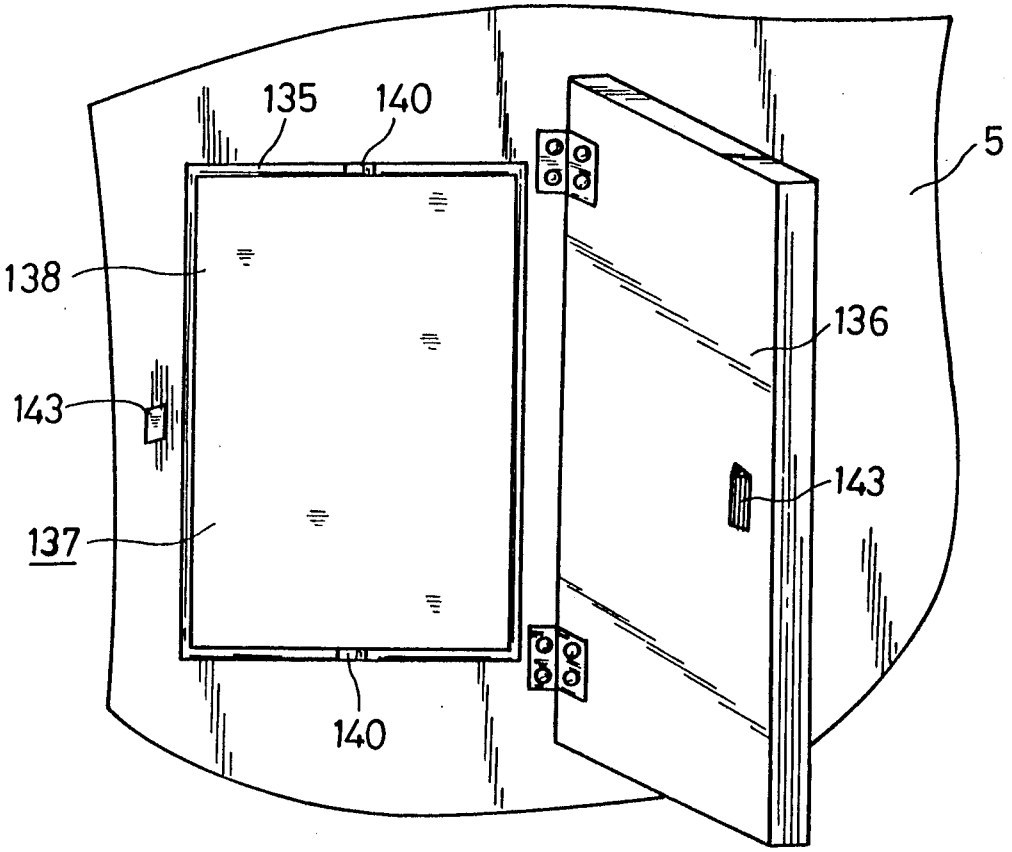
Figure 8:
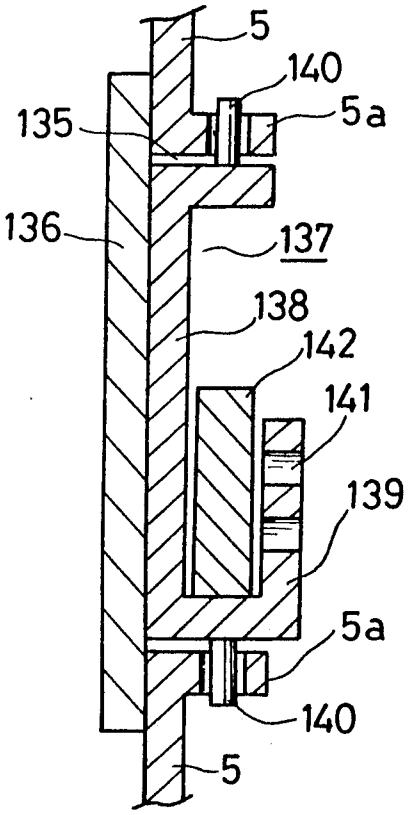
Figure 10:
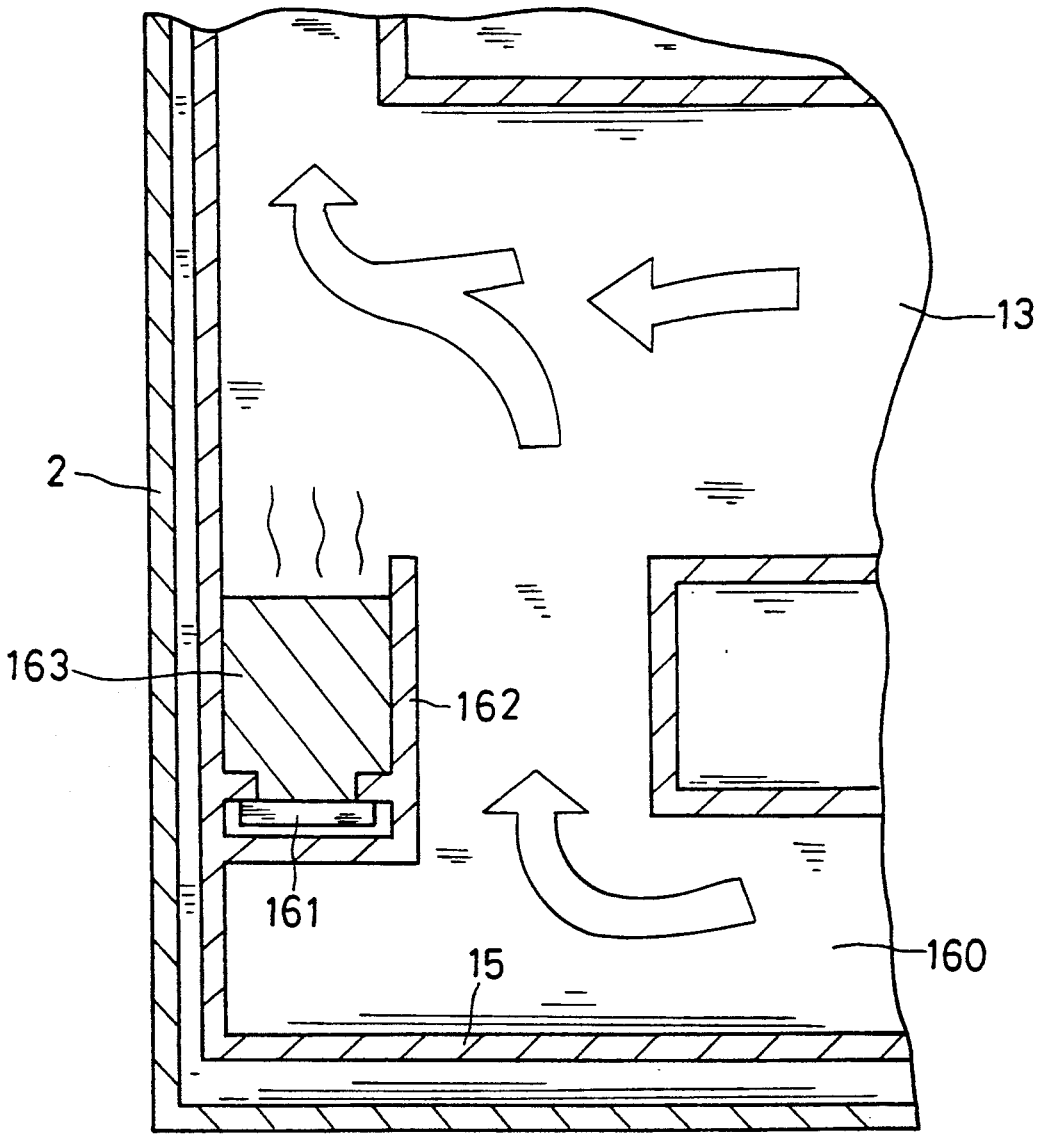
FIG. 10 is a sectional view showing another modification of the air path for reference.

FIGS. 7 to 9 shows another embodiment according to the present invention. Like reference numerals represent corresponding parts in this embodiment and the aforementioned embodiment, and description about them is omitted.

A clothes dryer of this embodiment comprises a minor opening 135 formed in the middle portion of the door 5, a lid 136 provided outside the door 5, and a supporting member 137 provided inside the door 5 corresponding to the minor opening 135. The supporting member 137 consists of a plate member slightly smaller than the minor opening 135, a receiving portion 139 formed on one side of the plate member 138 for holding a container described below, and a rotation shaft 140 supported during rotation by a bearing portion 5*a* in the door 5. The receiving portion 139 is provided with a air path 141. A porous member 142 is a container which can be detached from the receiving portion 139 of the supporting member 137. The porous member 142 is made specifically of sintered metal and can be loaded with a liquid agent such as an aromatic, and attached to the supporting member 137 with the liquid agent. The porous member 142 is placed so that it is exposed within the drying chamber. A magnet 143 is attached to each of the lid 136 and the door 5, so that when the lid 136 is closed with the porous member 142 on the supporting member 137 positioned in the drying chamber (see FIG. 9), the magnet 143 forces the minor opening 135 to be fixed in closed position. Closing the opening 136 prevents the supporting member 137 from rotating undesirably.

The porous member 142 is also heated by heated air during the drying process. This causes an aromatic impregnated into the porous member 142 to appear in the surface of the porous member 142. The aromatic flows to the drying chamber through the air path 141, fills the drying chamber and attaches to the clothes in the drying chamber to emit fragrance. This process is most effectively done in the dehumidifying type clothes dryer of this embodiment, because heated air is circulated inside the machine without exhaust out of the machine. Additionally, since the agent is not heated directly by the heater 17, there is no possibility of deterioration of the agent.

According to this embodiment, since the container is supported by the supporting member 137 which is held on the minor opening 135 of the door 5, in the drying chamber, so that there is an advantage that in exchanging the container, supply of the agent such as an aromatic, etc. can be easily performed without having to open the door 5.

The lid 136 in this embodiment should not necessarily be used. Instead of the lid 136, appropriate means such as a magnet, latch, hook, etc. may be employed as the supporting member 137 to prevent undesirable rotation of the supporting member 137.

In the case where a liquid agent is used instead of the container as in the present invention, a secondary air path 160 may be provided which has a cross section smaller than that of the heated air path 13 and serves as a bypass related to the heated air path 13, and a tank 162 having an ultrasonic oscillator 161 may be provided at the junction of the heated air path 13 and the secondary air path 160. In this case, an agent 163 is vaporized by the ultrasonic oscillator 161 and effectively diffuses within the drying chamber by the circulating air which runs through the secondary air path at a high speed.

As has been described, according to the two embodiments of a clothes dryer, employing a simple constitution having the container positioned in the drying chamber, an agent such as a softening agent and an aromatic can be applied to clothes, and a clothes dryer can be manufactured at moderate cost with decreased possibility of malfunction. In addition to that, the container can be easily detached for refill or exchange.

What is claimed is:

1. A clothes dryer comprising:

a body having a drying chamber for accommodating the clothes to be dried;

drying means for supplying heated air to said drying chamber to dry the clothes placed in said drying chamber;

a door attached to said body for closing and opening said drying chamber;

a container for holding an agent which can be vaporized by the heated air;

a hollow supporting member integral with said door for detachably supporting the container therein, said supporting member having an opening at an end thereof;

said supporting member having in its interior means for detachably holding said container including an engaging member, a pushing member resiliently urged toward said hollow supporting member opening and a holding member at the opening for limiting outward travel of the pushing member said container being detachable by releasing the engaging member from the force of said pushing member, at least one of said container and supporting member having an aperture through which part of the heated air supplied to said drying chamber flows to vaporize the agent in said container and for supplying the vaporized agent into said drying chamber.

2. A clothes dryer according to claim 1, wherein said drying chamber comprises a drum rotating in said body, said door is attached to a nonrotating portion of said body, said container having an engaging portion to mate with the engaging member of the supporting member and said container engaging portion and said supporting member engaging member engaging each other when said container is rotated relative to said holding member of said hollow supporting member.

3. A clothes dryer according to claim 1, wherein said door further comprises a minor opening providing communication to said drying chamber accessible from outside of the dryer, and said hollow supporting member comprises a mounting portion attached to the inner surface of said door with the interior thereof being accessible through said minor opening and for detachably mounting said container in said supporting member for supplying the agent therein to said drying chamber, said container being removable from outside of the dryer through said minor opening of the door.

4. A clothes dryer according to claim 3, wherein said pushing member comprises a coil spring and a pushing plate positioned between said coil spring and said holding member and capable of engaging with said engaging member by a push of said coil spring after said holding member is detached from said mounting portion.

5. A clothes dryer according to claim 1, wherein said drying chamber comprises a drum rotating in said body, and said drying means comprises:

a heater provided in said body, a heat exchange type double sided fan attached opposite to said drying chamber in said body and having a circulating fan face for circulating dried air heated by said heater to said drying chamber and a cooling fan face for taking in and conveying out cooled air, for subjected circulating dried air to carry out heat exchange with the introduced cooled air, said circulating fan face and said cooling fan face forming both sides of said heat exchange type double sided fan, and a partition plate having an inner peripheral portion of an opening opposite to an outer peripheral portion of said double sided fan, for separating a path for dried air from that of the path for cooled air together with said double sided fan in said body.

6. A clothes dryer according to claim 1, wherein said container is made of sintered material.

7. A clothes dryer according to claim 1, wherein said agent is a static electricity erasing agent, a softening agent or an aromatic.

8. A clothes dryer comprising:

a body having a drying chamber defined for accommodating clothes;

drying means for supplying heated air to said drying chamber to dry the clothes placed in said drying chamber;

a door for closing and opening said drying chamber;

a container holding an agent;

a supporting member for supporting the container provided on said door, which can be detached, holding said container and for supplying said agent held by said container into said drying chamber;

said door comprises a minor opening to the drying chamber from outside of the dryer and a minor door for opening and closing said minor opening, and said supporting member comprises a concave mounting portion attached to the inner surface of said door, mounting said container in said drying chamber for supplying the agent therein, and capable of taking said container out for replacement through said minor opening of the door when said minor door is opened.

* * * * *